US007543897B2

(12) United States Patent
Kim

(10) Patent No.: US 7,543,897 B2
(45) Date of Patent: Jun. 9, 2009

(54) DOOR OPENING PREVENTION DEVICE FOR REFRIGERATOR

(75) Inventor: Young-Nam Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 172 days.

(21) Appl. No.: 11/145,950

(22) Filed: Jun. 7, 2005

(65) Prior Publication Data

US 2005/0269923 A1 Dec. 8, 2005

(30) Foreign Application Priority Data

Jun. 8, 2004 (KR) ..... 10-2004-0041980

(51) Int. Cl.
*A47B 96/04* (2006.01)

(52) U.S. Cl. ..... 312/405; 312/296

(58) Field of Classification Search ..... 312/324, 312/326–329, 401, 405, 296; 49/366; 292/95, 292/96, 99, 101, 102, 107, 108, DIG. 69, 292/71, 6, DIG. 71; 62/440, 265; 220/592.02
See application file for complete search history.

(56) References Cited

U.S. PATENT DOCUMENTS 1,918,911 A * 7/1933 Hull ..... 49/313
1,956,127 A * 4/1934 McGarr ..... 49/366
2,541,453 A * 2/1951 West ..... 62/161
2,692,809 A * 10/1954 Kesling ..... 312/405
2,764,874 A * 10/1956 Sharpe ..... 62/161
2,767,040 A * 10/1956 Kesling ..... 312/296
3,004,309 A * 10/1961 Korodi ..... 49/478.1
3,694,015 A * 9/1972 Gley ..... 292/80
4,703,147 A * 10/1987 Happ et al. ..... 219/722
5,411,328 A * 5/1995 You ..... 312/405
5,425,205 A * 6/1995 Ha ..... 49/366
5,497,534 A * 3/1996 Caruso ..... 16/288
6,375,291 B1 * 4/2002 Nam et al. ..... 312/405
6,483,695 B1 * 11/2002 Hartstein ..... 361/680
6,526,766 B1 * 3/2003 Hiraoka et al. ..... 62/125
2006/0097612 A1 * 5/2006 Park ..... 312/405
2006/0232176 A1 * 10/2006 Kim et al. ..... 312/405
2008/0066481 A1 * 3/2008 An et al. ..... 62/265

FOREIGN PATENT DOCUMENTS

JP 2002206854 * 7/2002
JP 2003-121061 4/2003
KR 20-1997-0004282 5/1997

* cited by examiner

*Primary Examiner*—Janet M Wilkens
(74) *Attorney, Agent, or Firm*—Ked & Associates LLP

(57) ABSTRACT

A door opening prevention device is provided for a refrigerator. Stoppers are provided on both sides of a stopper plate provided on a ceiling of a refrigerating chamber. First and second doors for selectively opening and closing the refrigerating chamber are provided with catching hooks, respectively. When the first door and the second door close the refrigerating chamber, by allowing the catching hooks to be caught by the stoppers, the first and second doors are prevented from being inadvertently opened. In addition, a leaf spring 61 is provided which provides the catching hooks with an elastic force that prevents the catching hooks from being inadvertently detached from the stoppers in a state in which the catching hooks are caught to the stoppers this structure prevents during the opening and closing operation of any one of the doors the other door from being opened.

17 Claims, 6 Drawing Sheets

DOOR OPENING PREVENTION DEVICE FOR REFRIGERATOR

BACKGROUND OF THE INVENTION

1. Field of Invention

The present invention relates to a refrigerator, and more particularly, to a door opening prevention device for a refrigerator, which prevents a door from being inadvertently opened when the other adjacent door is opened or closed in the refrigerator in which a single storage chamber is opened and closed by the two doors.

2. Description of the Prior Art

FIGS. 1 and 2 show a related art refrigerator. Referring to these figures, a refrigerator main body 1 is provided with a refrigerating chamber 3 and a freezing chamber 5 into which the interior of the refrigerator main body 1 is divided. The refrigerating chamber 3 and the freezing chamber 5 are selectively opened and closed by refrigerating chamber doors 7 and 8 and a freezing chamber door 9, respectively.

The refrigerating chamber doors 7 and 8, which are rotatably installed on both ends of the refrigerator main body 1 through hinges, respectively. The distal ends of the refrigerating chamber doors 7 and 8 facing each other are rotatable toward the front of the refrigerator main body 1. Reference numeral 7*a* and 8*a* designate door handles for opening and closing the refrigerating chamber doors 7 and 8, respectively.

The refrigerating chamber doors 7 and 8 are provided with gaskets Ga, Gb, Gc, and Gd for preventing cold air from leaking out between the refrigerating chamber doors 7 and 8 and the front surface of the refrigerator main body 1 corresponding to edges of the refrigerating chamber 3 and between the free ends of the refrigerating chamber doors 7 and 8 facing each other.

The side gaskets Ga and Gc are provided on side surfaces corresponding to the free ends of the refrigerating chamber doors 7 and 8 facing each other, and the rear gaskets Gb and Gd extend from upper and lower ends of the side gaskets Ga and Gc and are provided on edges of rear surfaces on the refrigerating chamber doors 7 and 8. The rear gaskets Gb and Gd are provided on the edges of the rear surfaces on the refrigerating chamber doors 7 and 8 such that they can be brought into close contact with the front surface of the refrigerator main body 1.

Reference numerals 9*a*, 11, and 13 designate a door handle, a shelf on which stored goods are seated, and an accommodation box, respectively.

However, the related art refrigerator so configured has the following problems.

In order to open only a part of the refrigerating chamber 3, only one of the refrigerating chamber doors 7 and 8 should be opened. However, in a state where the refrigerating chamber doors 7 and 8 close the refrigerating chamber 3, the side gaskets Ga and Gc are in close contact with each other, particularly, by means of a magnetic force of magnets.

Thus, when any one of both the doors is opened in a state where the refrigerating chamber doors 7 and 8 are closed, the other door may also be opened simultaneously by means of the side gaskets Ga and Gc that are brought into close contact with each other by the magnetic force.

In addition, when any one of the refrigerating chamber doors 7 and 8 has been opened and then closed, the door causes outside air to be pushed into the refrigerating chamber 3, and consequently, the other closed door may be opened.

Therefore, users should always pay attention to the open and closed state of the refrigerating chamber doors 7 and 8. If the refrigerating chamber doors 7 and 8 remain carelessly in an open state, the cold air leaks out and the degree of freshness of goods stored in the refrigerating chamber 3 is deteriorated.

SUMMARY OF THE INVENTION

Accordingly, the present invention is conceived to solve the aforementioned problems in the prior art. An object of the present invention is to prevent a door from being opened when the other adjacent door is opened or closed in a refrigerator in which a single storage chamber is opened and closed by a plurality of doors.

According to an aspect of the present invention for achieving the objects, there is provided a door opening prevention device for a refrigerator in which a storage space defined in a main body of the refrigerator is opened and closed by at least two doors, comprising: a stopper provided on the ceiling or bottom of the storage space; a catching hook provided on the door for opening and closing the storage space and caught to the stopper in a state where the door is closed; and an elastic member for imparting an elastic force to the catching hook caught to the stopper in a direction in which the catching hook is brought into close contact with the stopper.

Preferably, the stopper includes a guide surface which guides the catching hook according to the opening and closing operation of the door, and a catching surface which faces the elastic member such that the catching hook is caught to the catching surface when the door was closed.

More preferably, the stopper is formed integrally on an inner surface of the storage space or on a side of a stopper plate fixed to the inner surface of the storage space.

More preferably, the catching hook includes a catching protrusion formed at a distal end thereof, the catching protrusion being guided by the guide surface and brought into close contact with the catching surface in a state where the door is closed, and a seating surface on which a portion between the guide surface and the catching surface is seated in a state where the door is closed.

More preferably, the catching hook is installed at a distal end of the door to be pivotal within a predetermined range and tends to rotate in a direction in which the catching hook is caught to the stopper while being supported by the elastic member.

More preferably the elastic member is a leaf spring for imparting an elastic force to bring the catching protrusion into close contact with a catching surface and is fixed to a base plate or an inner surface of the storage space.

More preferably each end of the leaf spring is formed into a curved surface with a predetermined radius of curvature and spaced apart by a predetermined gap from the catching surface of the stopper facing the leaf spring.

According to other aspect of the present invention for achieving the objects, there is provided a door opening prevention device for a refrigerator in which a single storage space defined in a main body of the refrigerator is opened and closed by first and second doors that are pivotal on both ends of the refrigerator main body, comprising: stoppers provided on the ceiling of the storage space corresponding to the first and second doors, respectively; catching hooks provided on upper surfaces of distal ends of the first and second doors for opening and closing the storage space to pivot in a direction in which distal ends of the catching hooks are caught to the stoppers with respect to the other ends thereof, respectively; and an elastic member for imparting an elastic force to the catching hooks caught to the stoppers in a direction in which the catching hooks are brought into close contact with the stoppers in a state where the first and second doors close the storage space.

Preferably, the stoppers are integrally formed on a stopper plate fixed to the ceiling of the storage space, and the elastic member is mounted to the stopper plate.

More preferably, each end of the elastic member is formed in a curved surface with a predetermined radius of curvature to be spaced apart by a predetermined gap from a portion of the stoppers facing the elastic member.

More preferably, the stopper includes: a guide surface which guides the catching hook according to the opening and closing operation of the door, said guide surfaces of both stoppers facing each other, and a catching surface which faces the elastic member such that the catching hooks is caught to the stopper in a state where the door is closed.

More preferably, the catching hook is installed at a distal end of the door to be pivotal within a predetermined range in a direction in which the catching hook is caught to the stopper, and includes a catching protrusion which is formed at a distal end thereof and guided by a guide surface and brought into close contact with the catching surface in a state where the door is closed.

According to the present invention so configured, the opening and closing operation of the doors of a refrigerator, in which a single storage chamber is opened and closed by a plurality of doors, is performed precisely at user's desire. Thus, it is possible to prevent cold air from leaking out and to maintain the degree of freshness of stored goods for a relatively long time. Further, there is an advantage in that the door can be more easily opened by an elastic force of an elastic member when the door is opened to a certain extent.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a door opening prevention device for a refrigerator according to the present invention will be described in detail with reference to the accompanying drawings.

Figure 1:
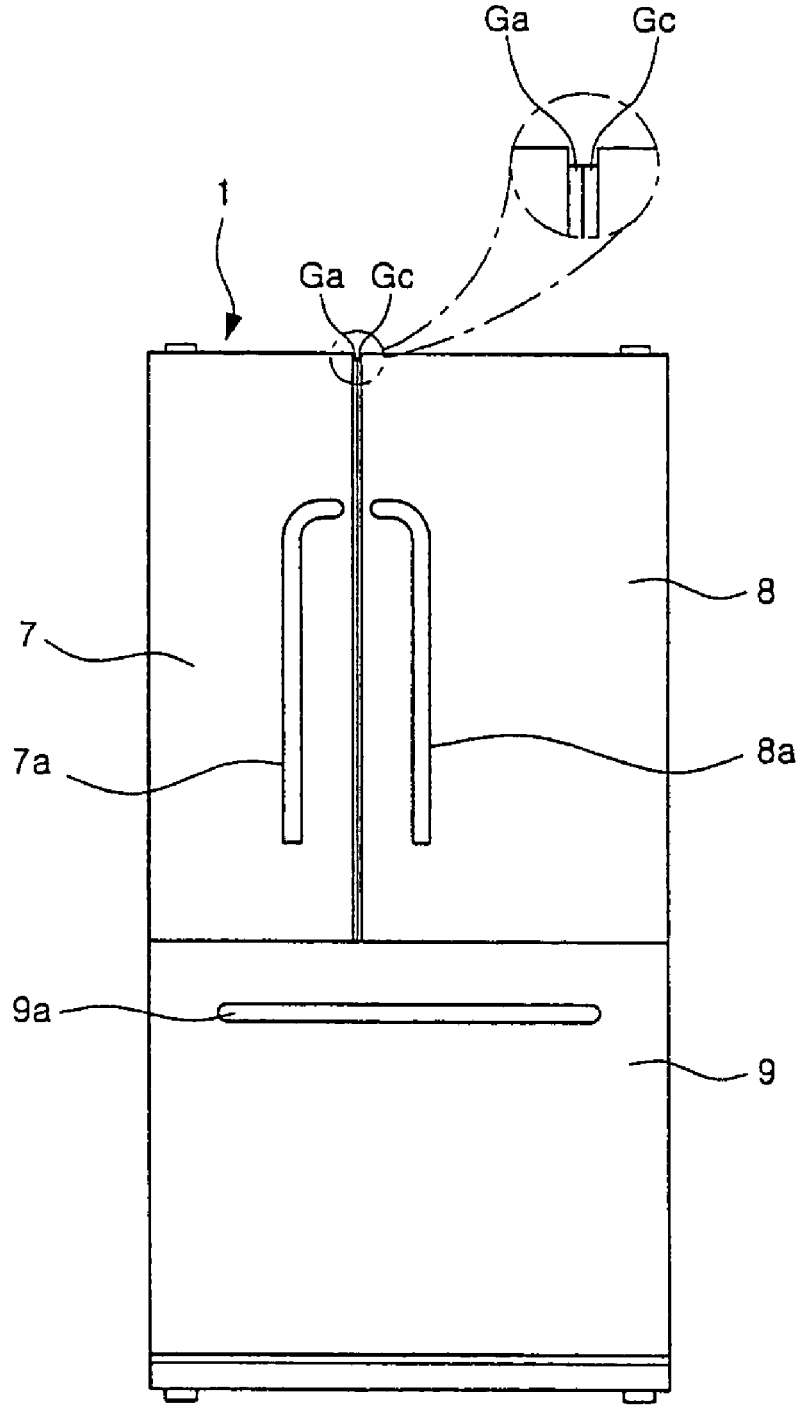
FIG. 1 Prior Art
FIG. 1 is a font view showing an external appearance of a related art refrigerator.
Figure 2:
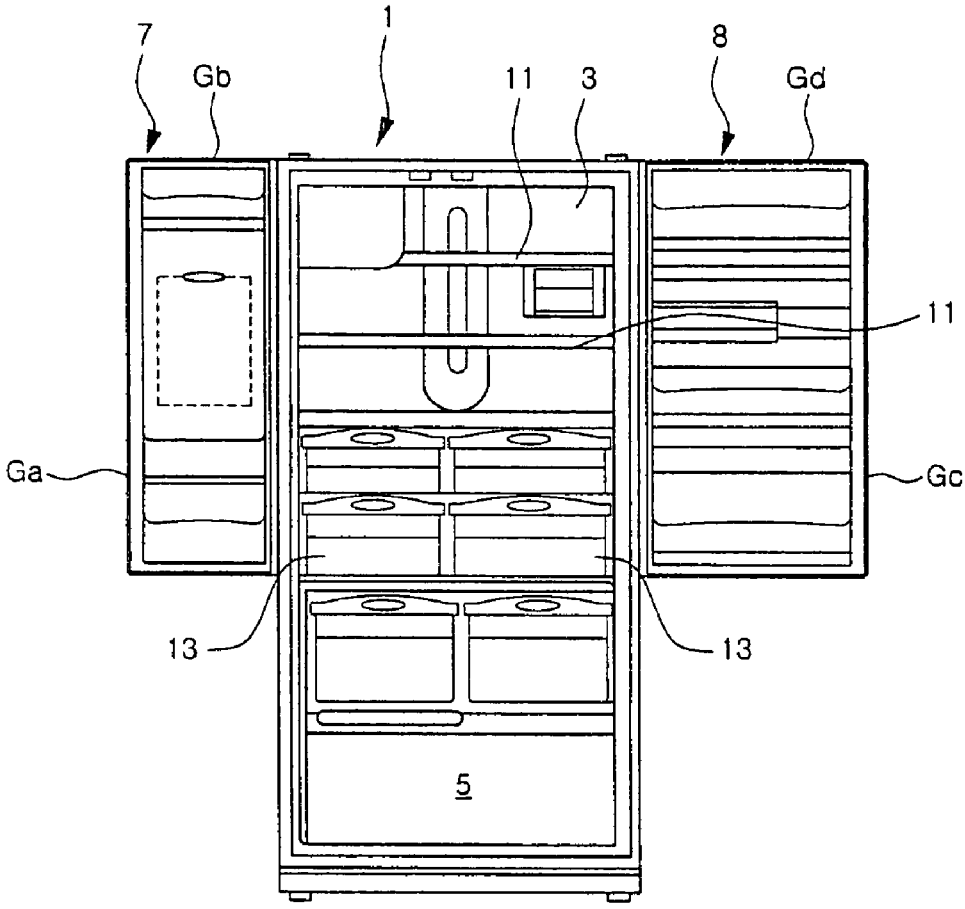
FIG. 2 Prior Art
FIG. 2 is a front view showing the interior configuration of the refrigerator shown in FIG. 1.
Figure 3:
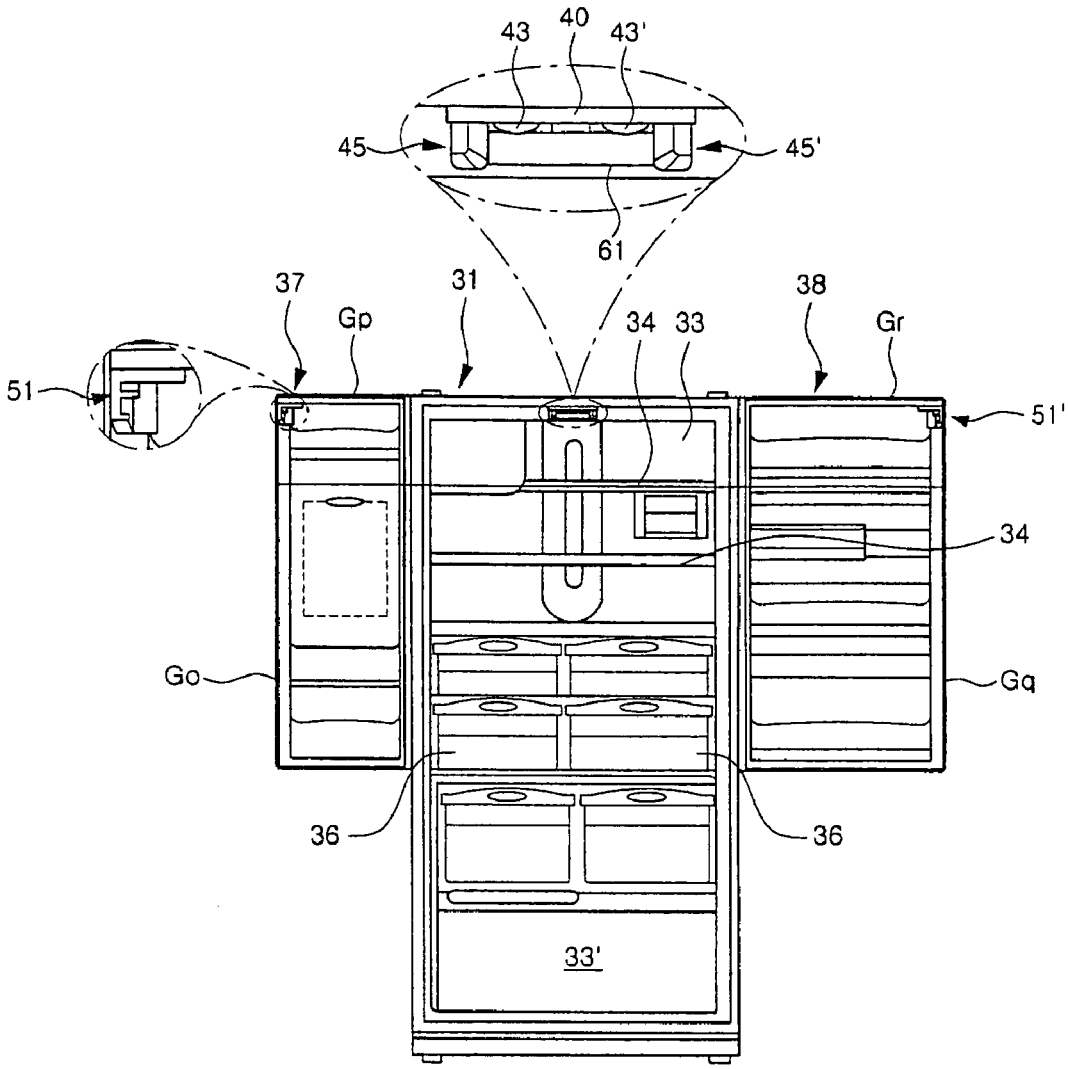
FIG. 3 is a front view showing a state where doors are opened in a refrigerator provided with a preferred embodiment of a door opening prevention device according to the present invention.
Figure 4:
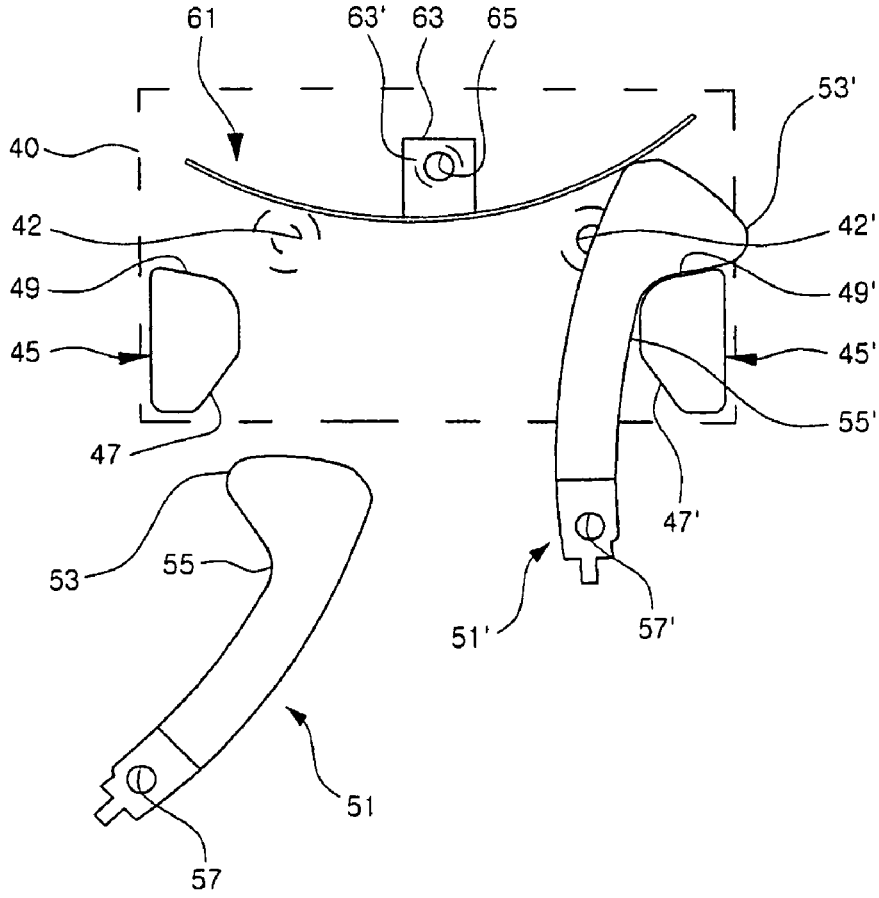
FIG. 4 is a transverse sectional view of the embodiment shown in FIG. 3.

FIG. 3 is a front view showing a refrigerator provided with a preferred embodiment of a door opening prevention device according to the present invention, and FIG. 4 is a transverse sectional view of the embodiment shown in FIG. 3.

As shown in the figure, a refrigerator main body 31 is provided with a storage space with a front face opened thereto. The storage space is divided into a refrigerating chamber 33 and a freezing chamber 33'. The refrigerating chamber 33 and the freezing chamber 33' are equipped with a plurality of shelves 34 on upper surfaces of which foods are seated. In addition, accommodation boxes 36 in which foods are accommodated are equipped in the refrigerating and freezing chambers 33 and 33' so that the accommodation boxes can be drawn to the front of the refrigerator.

In order to selectively open and close the refrigerating chamber 33, there are provided a first refrigerating chamber door 37 (hereinafter, the "first door") and a second refrigerating chamber door 38 (hereinafter, the "second door"). The first and second doors 37 and 38 rotate about the left and right side ends in FIG. 3, respectively, and then open and close the refrigerating chamber 33.

Further, side gaskets Go and Gq which vertically extend are provided on side surfaces corresponding to distal ends of the first and second doors 37 and 38, respectively. The side gaskets Go and Gq prevent cold air leakage between the first and second doors 37 and 38. To this end, the side gaskets Go and Gq are provided with magnets (not shown) therein to have a magnetic force. Thus, the magnetic force brings the first and second doors 37 and 38 into close contact with each other.

Rear gaskets Gp and Gr are provided on edges of the rear surfaces of the first and second doors 37 and 38, respectively. The rear gaskets Gp and Gr, which have a predetermined magnetic force the same as the side gaskets Go and Gq, are provided along the edges of the rear surfaces of the first and second doors 37 and 38 corresponding to the front surface of the refrigerator main body 31. The rear gaskets Gp and Gr are connected to upper and lower ends of the side gaskets Go and Gq. The rear gaskets Gp and Gr are brought into close contact with the front surface of the refrigerator main body 31 by the magnetic force in a state where the first and second doors 37 and 38 close the refrigerating chamber 33.

In order to selectively open and close the freezing chamber 33', there is provided a freezing chamber door (not shown). The freezing chamber door is installed such that the door can be withdrawn to the front of the refrigerator in a sliding manner. In the present embodiment, the refrigerating chamber 33 is opened and closed by the two refrigerating chamber doors 37 and 38, but it is not necessarily so. That is, the freezing chamber 33' may be configured to be opened and closed by two doors.

In the meantime, a stopper plate 40 is provided on the ceiling of the refrigerating chamber 33. The stopper plate 40 is provided on the front end of the ceiling of the refrigerating chamber 33 corresponding to just rear portions of the upper portions of the distal ends of the doors 37 and 38 in a state where the first and second doors 37 and 38 close the refrigerating chamber 33.

As shown in FIG. 4, at least a pair of fastening holes 42 and 42' are bored through the stopper plate 40. The fastening holes 42 and 42' for the purpose of fixing the stopper plate 40 to the ceiling of the refrigerating chamber 33 are fastened to the ceiling of the refrigerating chamber 33 by means of screws 43 and 43' passing through the fastening holes 42 and 42'.

Stoppers 45 and 45' are provided at both sides of the stopper plate 40, respectively. The stoppers 45 and 45', which are formed integrally with the stopper plate 40, protrude downwardly from the stopper plate 40. The stoppers 45 and 45' include guide surfaces 47 and 47' for guiding the movement of catching hooks 51 and 51', which will be described below, and catching surfaces 49 and 49' with which catching protrusions 53 and 53' of the catching hooks 51 and 51' are brought into close contact, respectively.

The guide surfaces 47 and 47' are formed to correspond to traces along which the catching protrusions 53 and 53' of the catching hooks 51 and 51' move due to the rotations of the first and second doors 37 and 38. The catching surfaces 49 and 49' extend from the guide surfaces 47 and 47' and formed to substantially face the inner surface of the refrigerating chamber 33. The stoppers 45 and 45' are provided at both the sides of the stopper plate 40 so that the guide surfaces 47 and 47' face each other.

Figure 5:
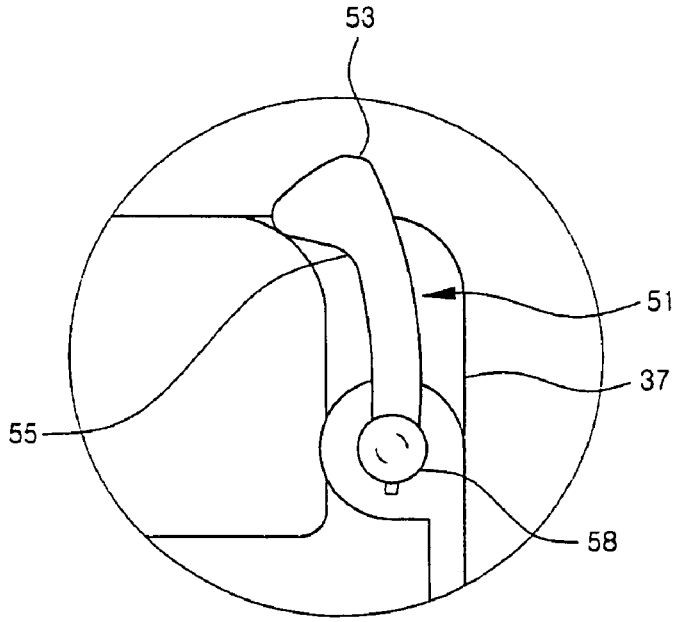
FIG. 5 is a plan view showing a state where catching hooks of the embodiment shown in FIG. 3 are installed to the doors.

In the meantime, as shown in FIG. 5, the first and second doors 37 and 38 are provided with the catching hooks 51 and 51', respectively. The catching hooks 51 and 51', which are caught to the stoppers 45 and 45' in a state where the first door 37 and the second door 38 close the refrigerating chamber 33, are rotatably installed at upper surfaces of the distal ends of the first and second doors 37 and 38.

The catching protrusions 53 and 53' are provided on distal ends of the catching hooks 51 and 51', respectively. The catching protrusions 53 and 53' are guided along the guide surfaces 47 and 47' in the opening and closing process of the first door 37 and the second door 38 while the catching protrusions 53 and 53' are caught to the catching surfaces 49 and 49' in a state where the first door 37 and the second door 38 are closed, that is, the refrigerating chamber 33 is closed.

Seating surfaces 55 and 55' are provided at the portions of the catching hooks 51 and 51' adjacent to the catching protrusions 53 and 53', respectively. The seating surfaces 55 and 55' are formed in a shape corresponding to the guide surfaces 47 and 47'. The seating surfaces 55 and 55' are seated on portions where the catching surfaces 49 and 49' and the guide surfaces 47 and 47' are connected to each other in a state where the catching protrusions 53 and 53' are in close contact with the catching surfaces 49 and 49', respectively.

Through holes 57 and 57' are vertically bored through rear ends of the catching hooks 51 and 51' corresponding to opposite sides of the catching protrusions 53 and 53', respectively. Screws 58 passing through the through holes 57 and 57' are fixed to the first door 37 and the second door 38, so that the catching hooks 51 and 51' rotate about the through holes 57 and 57'.

The catching hooks 51 and 51' may rotate up to positions where they are inclined at a predetermined angle toward the distal ends of the first door 37 and the second door 38 from positions where they are substantially perpendicular to the rear surfaces of the first door 37 and the second door 38. Here, the positions where the catching hooks 51 and 51' are substantially perpendicular to the rear surfaces of the first door 37 and the second door 38 are the same as the positions of the catching hooks 51 and 51' in a state where they are caught to the stoppers 45 and 45'. In addition, the positions where the catching hooks 51 and 51' are maximally inclined with respect to the distal ends of the first door 37 and the second door 38 are determined so as to be guided by the guide surfaces 47 and 47' while the catching protrusions 53 and 53' are free from interference in the opening and closing process of the first door 37 and the second door 38.

In addition, although not shown, the catching hooks 51 and 51' are supported to rotate in the direction in which they are caught to the stoppers 45 and 45' by means of an elastic member. That is, the elastic member causes the catching hooks 51 and 51' to tend to rotate about the screws 58 in the direction in which the catching hooks 51 and 51' are caught to the stoppers 45 and 45'.

A leaf spring 61 is provided at a position in the stopper plate 40 spaced apart from between the stoppers 45 and 45'. The leaf spring 61 is for the purpose of preventing the catching hooks 51 and 51' from being inadvertently detached from the stoppers 45 and 45' in a state where the catching hooks 51 and 51' are caught to the stoppers 45 and 45'. The leaf spring 61 is installed to be substantially perpendicular to the surface of the stopper plate 40.

The leaf spring 61 is designed in such a manner that both ends thereof have a predetermined radius of curvature to face the rear of the refrigerator, respectively. Thus, gaps between both the ends of the leaf spring 61 and the catching surfaces 49 and 49' are generally kept to be substantially constant. Both the ends of the leaf spring 61 face the stoppers 45 and 45', respectively.

The leaf spring 61 serves to impart a predetermined elastic force to the catching hooks 51 and 51'. To this end, a straight distance between the catching surface 49 or 49' of the stoppers 45 or 45' and one end of the leaf spring 61 is at least relatively shorter than the width of the catching protrusion 53 or 53' of the catching hook 51 or 51' that is brought into close contact with the leaf spring 61 and the catching surface 49 or 49'. Thus, the leaf spring 61 imparts the elastic force to the distal ends of the catching hooks 51 and 51' in the direction in which the catching protrusions 53 and 53' are brought into close contact with the catching surfaces 49 and 49'.

The leaf spring 61 is provided with a fastening piece 63. The fastening piece 63 is provided on an upper end of the leaf spring 61 and is bent perpendicular to the leaf spring 61. At least a fastening hole 65 is bored through the fastening piece 63. A screw 63' passing through the fastening hole 65 is fastened to the ceiling of the refrigerating chamber 33 or the stopper plate 40 to be fixed thereto.

Hereinafter, the operation of the door opening prevention device for a refrigerator according to the present invention so configured will be described in detail.

Figure 6A:
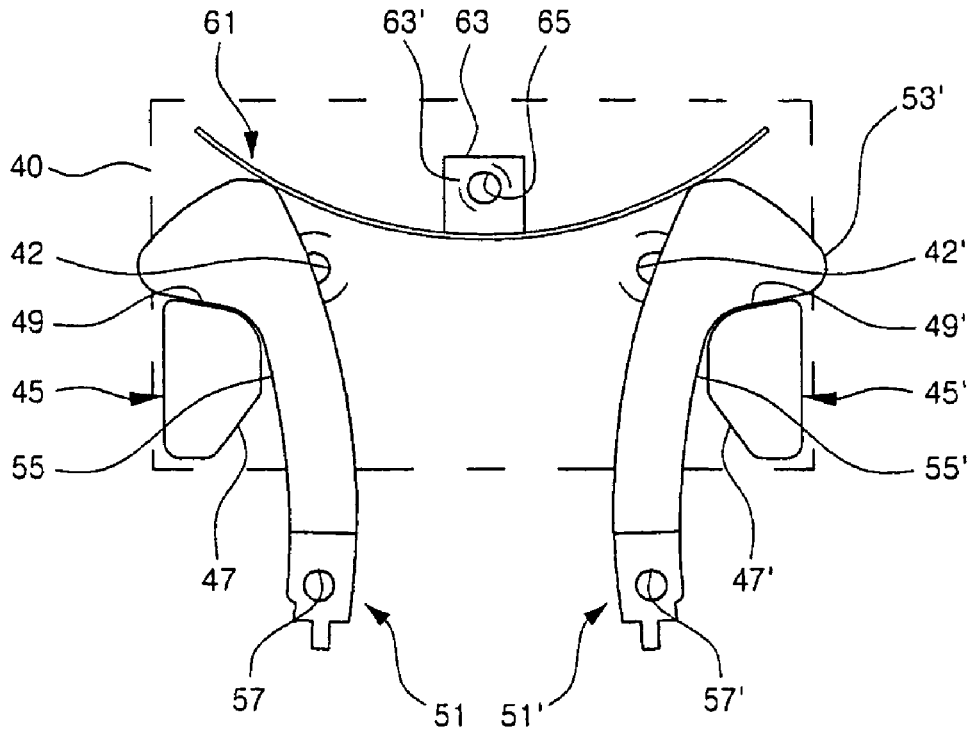
FIGS. 6*a* to 6*c* are views showing a process of opening and closing the doors according to the embodiment shown in FIG. 3.
Figure 6B:
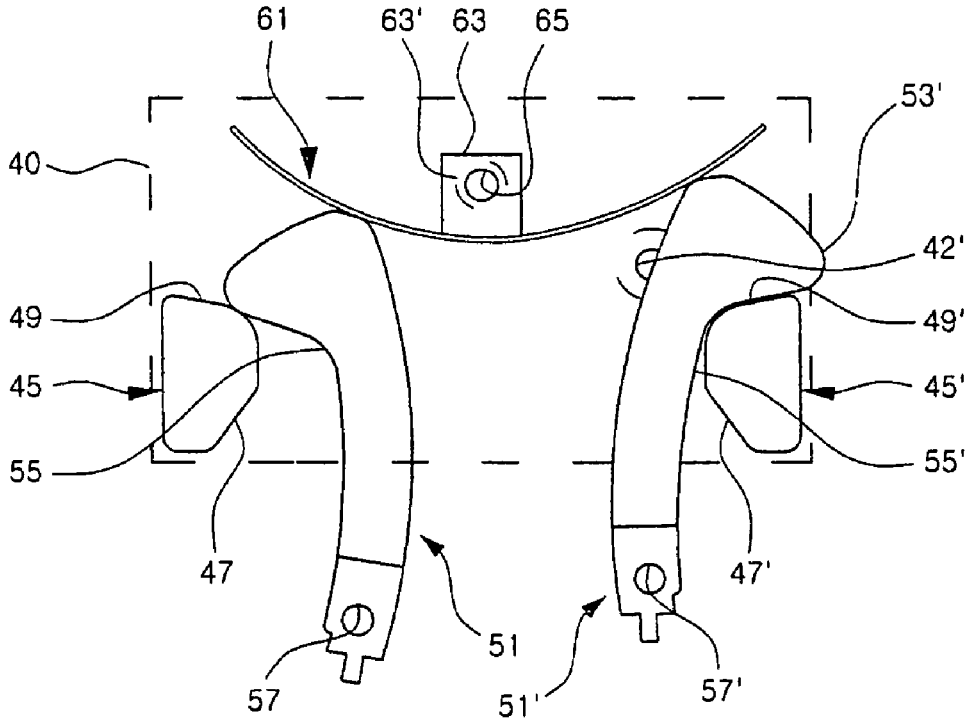
Figure 6C:
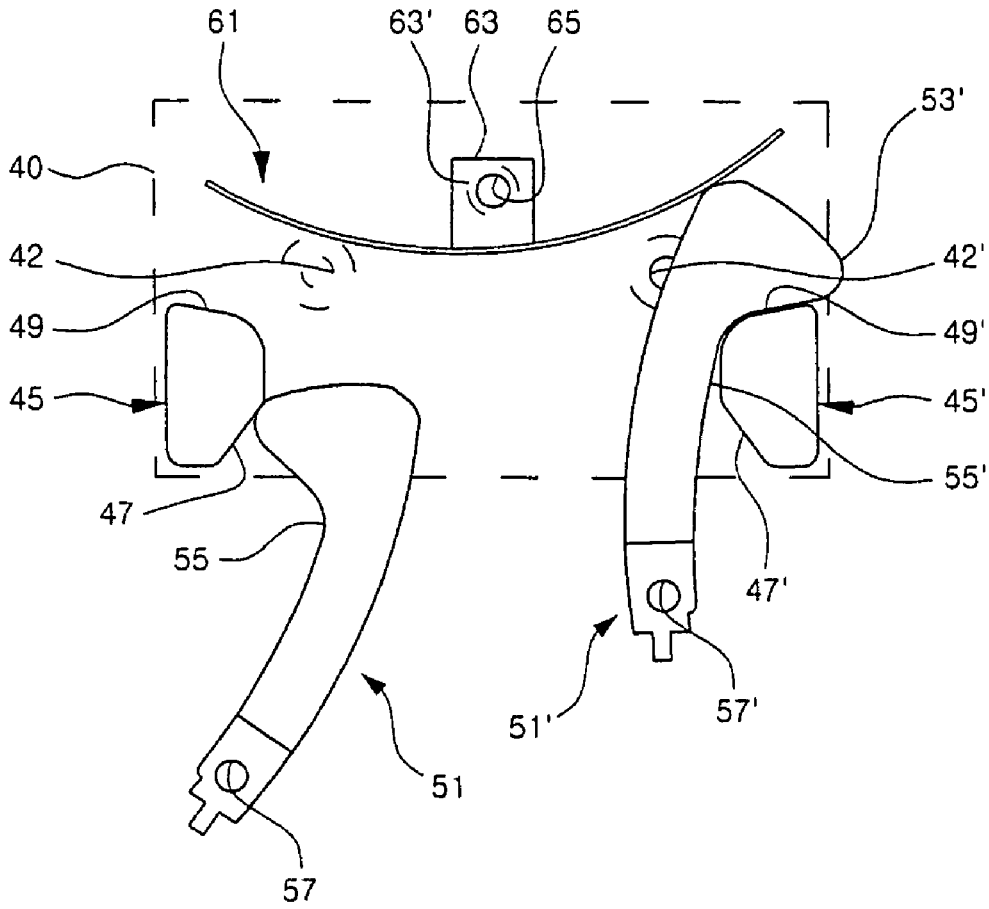

In the present invention, a process of opening and closing the first and second doors 37 and 38 is shown in FIGS. 6*a* to 6*c*. Referring to the figures, the process of opening and closing the first and second doors 37 and 38 will be described.

First, as shown in FIG. 6*a*, in a state where the refrigerating chamber 33 of the refrigerator is closed by the first and second doors 37 and 38, the catching protrusions 53 and 53' of the catching hooks 51 and 51' provided on the first and second doors 37 and 38 are caught to and brought into close contact with the catching surfaces 49 and 49' of the stoppers 45 and 45'. Then, the seating surfaces 55 and 55' of the catching hooks 51 and 51' are seated on positions corresponding to that between the catching surfaces 49 and 49' and the guide surfaces 47 and 47' of the stoppers 45 and 45'.

At this time, the side gaskets Go and Gq of the first and second doors 37 and 38 are in close contact with each other and the rear gaskets Gp and Gr of the first and second doors 37 and 38 are in close contact with the front surface of the refrigerator main body 31, respectively. Thus, the refrigerating chamber 33 is closed by the first and second doors 37 and 38.

The leaf spring 61 causes the catching hooks 51 and 51' to be subjected to the elastic force in the direction in which the catching protrusions 53 and 53' are brought into close contact with the catching surfaces 49 and 49', respectively. Thus, the catching hooks 51 and 51' are caused not to inadvertently move in a state where the catching hooks 51 and 51' are caught to the stoppers 45 and 45', so that the first and second doors 37 and 38 are caused not to be inadvertently opened.

In such a state, when the first door 37 is opened in order to open the right side portion (in FIG. 3) of the refrigerating chamber 33, the distal end of the first door 37 rotates about its left side end to the front of the refrigerator, and the catching hook 51 of the first door 37 also moves to the front of the refrigerator.

However, the catching hook 51 is subjected to the elastic force caused from the leaf spring 61. Thus, in order to open the first door 37, the first door 37 should be pulled to the front of the refrigerator with a force larger than the elastic force of the leaf spring 61 exerted to the catching hook 51.

In addition, if the first door 37 is opened as the catching hook 51 overcomes the elastic force of the leaf spring 61 as described above, the catching protrusion 53 moves in a state where the catching protrusion 53 is in close contact with the catching surface 49, as shown in FIG. 6*b*. Further, the guide surface 47 is separated from the seating surface 55 in a state where the guide surface 47 is seated on the seating surface 55, and then the seating surface 55 moves in the direction in which the seating surface 55 gets away from the guide surface 47.

Furthermore, while the first door 37 rotates, the side gasket Go and the rear gasket Gp of the first door 37 get away from the side gasket Gq of the second door 38 and the front surface of the main body 31, respectively. However, since the side gaskets Go and Gq were in close contact with each other by the elastic force, the side gasket Gq of the second door 38 can be pulled by the side gasket Go of the first door 37 during the separation process. That is, the second door 38 in a closed state can be opened by the first door 37.

However, the catching hook 51' of the second door 38 maintains a state where it is caught to the stopper 45' by the elastic force provided from the leaf spring 61. Thus, since the opening of the first door 37 does not influence the second door 38, the second door 38 is not opened.

In the meantime, although the catching hook 51 moves and the catching protrusion 53 are then spaced apart from the catching surface 49 by a predetermined distance or more, the elastic force of the leaf spring 61 is continuously exerted to the catching hook 51. However, the elastic force of the leaf spring 61 is exerted in a direction in which the catching protrusion 53 is brought into close contact with the catching surface 49. Thus, if the catching protrusion 53 has been separated from the catching surface 49, the catching hook 51 is contrarily pushed to the front of the refrigerator by an restoring force of the leaf spring 61. Thus, the first door 37 can be opened more smoothly.

In addition, as shown in FIG. 6*c*, the rotation of the first door 37 causes the catching hook 51, which is separated from the stopper 45 and moves to the front of the refrigerator, to be spaced apart from the leaf spring 61. At this time, the catching protrusion 53 is guided to the front of the refrigerator along the guide surface 47. Then, when the first door 37 is continuously opened, the catching hook 51 is completely separated from the stopper 45, so that the portion of the refrigerating chamber 33 corresponding to the first door 37 is opened.

In such a state where the refrigerating chamber 33 is opened, a process of closing the first door 37 for closing the refrigerating chamber 33 is performed reversely to the opening process of the refrigerating chamber 33. That is, when the first door 37 is pushed with its left side end in FIG. 3 as the center toward the front surface of the refrigerator main body 31, the catching protrusion 53 pushes the leaf spring 61 toward the rear of the refrigerator while being guided by the guide surface 47.

Then, if the force causing the first door 37 to rotate is larger than the elastic force of the leaf spring 61, the catching protrusion 53 moves while overcoming the elastic force of the leaf spring 61. Thus, the catching protrusion 53 is brought into close contact with the catching surface 49 and the guide surface 47 is seated on the seating surface 55, so that the catching hook 51 is caught to the stopper 45.

At this time, the catching hook 51' of the second door 38 is maintained in a state where it is caught to the stopper 45' by the elastic force of the leaf spring 61. Thus, it is also prevented that the second door 38 is opened by outside air that is introduced into the refrigerating chamber 33 when the first door 37 is closed.

If the first door 37 is closed as above, the side gasket Go of the first door 37 is brought into close contact with the side gasket Gq of the second door 38, and the rear gasket Gp of the first door 37 is brought into close contact with the front surface of the main body 31. Thus, the refrigerating chamber 33 is closed from the outside again.

According to the door opening prevention device for a refrigerator of the present invention so configured, the following advantages can be expected.

That is, in a refrigerator in which a single storage space is opened and closed by a plurality of doors, the opening and closing operation of any one of the doors does not have influence on the other adjacent doors.

Thus, a state where the doors are opened or closed is maintained at a door state operated by a user. Therefore, the cold air in the storage space is prevented from leaking out, and thus, the power consumption of the refrigerator is relatively reduced. In addition, the degree of freshness of goods stored in the storage space can be maintained for a relatively long time.

Further, if the door is opened to some extent or more, the restoring force of the leaf spring pushes the catching hook in the direction in which the door is opened. Thus, it is possible to obtain an effect of securing the opening operation of the door.

The scope of the present invention is not limited to the embodiment described and illustrated above but is defined by the appended claims. It will be apparent that those skilled in the art can make various modifications and changes thereto within the scope of the fundamentally technical spirit of the present invention. Therefore, the true scope of the present invention should be defined on the basis of the appended claims.

For example, although it is described that the refrigerating chamber 33 is opened and closed by two doors 37 and 38 in the shown embodiment, it is also possible to apply the present invention to a case where the storage space is opened and closed by two or more doors.

Furthermore, in the present invention, the stopper plate 40 provided with the stoppers 45 and 45' is provided on the ceiling of the refrigerating chamber 33 and the catching hooks 51 and 51' are installed on the upper portions of the distal ends of the doors 37 and 38. However, the above configuration may be provided on the bottom of the refrigerating chamber 33 and the positions corresponding to lower ends of the refrigerating chamber doors 37 and 38.

In addition, although the stoppers 45 and 45' are formed integrally with the stopper plate 40 in the present embodiment, the stoppers 45 and 45' may be formed integrally with an inner case defining the inner surface of the refrigerating chamber 33.

What is claimed is:

1. A door opening prevention device in a refrigerator in which a storage space defined in a main body of the refrigerator is opened and closed by at least two doors, the device comprising:

at least one stopper provided on a ceiling or bottom of the storage space;

at least one catching hook rotatably mounted on at least one of the at least two doors and caught by the at least one stopper in a state in which at least one of the at least two doors is closed; and an elastic member provided on the ceiling or bottom of the storage space separate from the at least one stopper and configured to impart an elastic force onto the at least one catching hook to push the at least one catching hook into close contact with the at least one stopper, wherein the elastic member is provided at a position which is a predetermined distance apart in a rearward direction from the at least one stopper.

2. The door opening prevention device as claimed in claim 1, wherein the at least one stopper includes a guide surface that guides the at least one catching hook according to the opening and closing operation of the at least one of the at least two doors, and a catching surface that faces the elastic member such that the at least one catching hook is caught to the catching surface when the at least one of the at least two doors is closed.

3. The door opening prevention device as claimed in claim 2, wherein the at least one stopper is formed integrally on an inner surface of the storage space or on a side of a stopper plate fixed to the inner surface of the storage space.

4. The door opening prevention device as claimed in claim 2, wherein the at least one catching hook includes a catching protrusion formed at a distal end thereof, the catching protrusion being guided by the guide surface and brought into close contact with the catching surface in a state in which the at least one of the at least two doors is closed, and a seating surface on which a portion between the guide surface and the catching surface is seated in a state in which the at least one of the at least two doors is closed.

5. The door opening prevention device as claimed in claim 1, wherein the at least one catching hook is installed at a distal end of the at least one of the at least two doors to be pivotal within a predetermined range and tends to rotate in a direction in which the at least one catching hook is caught to the at least one stopper while being supported by the elastic member.

6. The door opening prevention device as claimed in claim 1, wherein the at least one catching hook includes a catching protrusion at a distal end thereof and the elastic member is a leaf spring configured to impart an elastic force to bring the catching protrusion into close contact with a catching surface of the at least one stopper and is fixed to a base plate or an inner surface of the storage space.

7. The door opening prevention device as claimed in claim 6, wherein each end of the leaf spring is formed into a curved surface with a predetermined radius of curvature and spaced apart by a predetermined gap from the catching surface of the at least one stopper facing the leaf spring.

8. A door opening prevention device in a refrigerator in which a single storage space defined in a main body of the refrigerator is opened and closed by first and second doors that are pivotal on both ends of the main body, the device comprising:

stoppers provided on a ceiling of the storage space corresponding to the first and second doors, respectively;

catching hooks rotatably mounted, respectively, on upper surfaces of distal ends of the first and second doors which open and close the storage space by pivoting in a direction in which distal ends of the catching hooks are caught by the stoppers with respect to the other ends thereof, respectively; and an elastic member provided on the ceiling of the storage space separate from the stoppers and configured to impart an elastic force to the catching hooks to push the catching hooks into close contact with the stoppers in a state in which the first and second doors close the storage space, wherein the elastic member is provided at a position which is a predetermined distance apart in a rearward direction from the stoppers.

9. The door opening prevention device as claimed in claim 8, wherein the stoppers are integrally formed on a stopper plate fixed to the ceiling of the storage space, and the elastic member is mounted to the stopper plate.

10. The door opening prevention device as claimed in claim 8, wherein each end of the elastic member is formed in a curved surface with a predetermined radius of curvature to be spaced apart by a predetermined gap from a portion of the stoppers facing the elastic member.

11. The door opening prevention device as claimed in claim 8, wherein the stopper each include:

a guide surface that guides a respective catching hook of the catching hooks according to the opening and closing operation of the respective door, the guide surfaces of the stoppers facing each other; and a catching surface that faces the elastic member such that the catching hooks are caught to the respective stopper in a state in which the respective door is closed.

12. The door opening prevention device as claimed in claim 8, wherein the catching hooks are installed at a distal end of the doors, respectively, to be pivotal within a predetermined range in a direction in which the catching hooks are caught to the stoppers, and each includes a catching protrusion which is formed at a distal end thereof and guided by a guide surface and brought into close contact with the catching surface in a state in which the respective door is closed.

13. A door opening prevention device in a refrigerator in which a storage space defined in a main body of the refrigerator is opened and closed by at least two doors, the device comprising:

at least one stopper provided on a ceiling or bottom of the storage space;

at least one catching hook provided on at least one of the at least two doors and caught by the at least one stopper in a state in which at least one of the at least two doors is closed; and an elastic member in the form of a curved leaf spring provided on the ceiling or bottom of the storage space separate from the at least one stopper and configured to impart an elastic force onto the at least one catching hook to push the at least one catching hook into close contact with the at least one stopper, wherein the elastic member is provided at a position which is a predetermined distance apart in a rearward direction from the at least one stopper.

14. The door opening prevention device as claimed in claim 13, wherein the at least one stopper includes a guide surface that guides the at least one catching hook according to the opening and closing operation of the at least one of the at least two doors, and a catching surface that faces the elastic member such that the at least one catching hook is caught to the catching surface when the at least one of the at least two doors is closed.

15. The door opening prevention device as claimed in claim 13, wherein the at least one catching hook is rotatably installed at a distal end of the at least one of the at least two doors to be pivotal within a predetermined range and tends to rotate in a direction in which the at least one catching hook is caught to the at least one stopper while being supported by the elastic member.

16. The door opening prevention device as claimed in claim 13, wherein the at least one catching hook includes a catching protrusion at a distal end thereof and the curved leaf spring configured to impart an elastic force to bring the catching protrusion into close contact with a catching surface of the at least one stopper and is fixed to a base plate or an inner surface of the storage space.

17. The door opening prevention device as claimed in claim 13, wherein the curved leaf spring is spaced apart by a predetermined gap from a catching surface of the at least one stopper facing the curved leaf spring.

* * * * *